US008049401B2

(12) United States Patent
Wang et al.

(10) Patent No.: US 8,049,401 B2
(45) Date of Patent: Nov. 1, 2011

(54) ELECTRON EMISSION DEVICE

(75) Inventors: Po-Hung Wang, Kaohsiung County (TW); Jung-Yu Li, Taipei County (TW); Shih-Pu Chen, Hsinchu (TW); Yi-Ping Lin, Changhua County (TW); Yen-I Chou, Hsinchu (TW); Ming-Chung Liu, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 163 days.

(21) Appl. No.: 12/414,666

(22) Filed: Mar. 31, 2009

(65) Prior Publication Data

US 2010/0141112 A1 Jun. 10, 2010

(30) Foreign Application Priority Data

Dec. 4, 2008 (TW) ..... 97147162 A

(51) Int. Cl.
*H01J 17/00* (2006.01)

(52) U.S. Cl. ..... 313/491; 313/574; 313/631

(58) Field of Classification Search ..... None
See application file for complete search history.

(56) References Cited

U.S. PATENT DOCUMENTS

| | | | | |
|---|---|---|---|---|
| 4,236,096 | A | 11/1980 | Tiemann | |
| 4,955,029 | A | 9/1990 | Lecoy et al. | |
| 5,604,757 | A | 2/1997 | Liang et al. | |
| 6,087,766 | A * | 7/2000 | Janning | 313/336 |
| 6,292,497 | B1 | 9/2001 | Nakano | |
| 2001/0024084 | A1 * | 9/2001 | Kajiwara | 313/486 |
| 2002/0093278 | A1 * | 7/2002 | Wells et al. | 313/309 |
| 2005/0082959 | A1 * | 4/2005 | Sasaki et al. | 313/311 |
| 2005/0179355 | A1 * | 8/2005 | Yoo et al. | 313/311 |
| 2007/0222355 | A1 | 9/2007 | Tsou et al. | |

FOREIGN PATENT DOCUMENTS

| | | |
|---|---|---|
| CN | 1822739 | 8/2006 |
| CN | 1532611 | 10/2006 |
| CN | 101211748 | 7/2008 |
| CN | 101303962 | 11/2008 |

* cited by examiner

*Primary Examiner* — Ashok Patel
(74) *Attorney, Agent, or Firm* — Jianq Chyun IP Office

(57) ABSTRACT

An electron emission device including a first substrate, a second substrate, a gas, a sealant, and a phosphor layer is provided. The first substrate has a cathode thereon, and the cathode has a patterned profile. The second substrate is opposite to the first substrate and has an anode thereon. The sealant is disposed at edges of the first substrate and the second substrate to assemble the first and second substrates. The gas is disposed between the cathode and the anode and configured to induce a plurality of electrons from the cathode, wherein the pressure of the gas is between 10 torr and $10^{-3}$ torr. The phosphor layer is disposed on the moving path of the electrons to react with the electrons so as to emit light.

13 Claims, 7 Drawing Sheets

ELECTRON EMISSION DEVICE

CROSS-REFERENCE TO RELATED APPLICATION

This application claims the priority benefit of Taiwan application serial no. 97147162, filed on Dec. 4, 2008. The entirety of the above-mentioned patent application is hereby incorporated by reference herein and made a part of specification.

BACKGROUND OF THE INVENTION

1. Field of the Invention

The present invention relates to a light emitting device and a method of packaging the same. More particularly, the present invention relates to an electron emission device and a method of packaging the same.

2. Description of Related Art

Currently, light emitting devices applied in existing mass-produced include gas discharge light sources and field emission light sources. The gas discharge light source may be applied to a plasma panel or a gas discharge lamp, wherein gas that filled in a discharge chamber is dissociated under the effect of an electric field between a cathode and an anode, and due to gas conduction, transition occurs and ultra violet (UV) light is emitted when electrons collide with gas, and phosphor in the same discharge chamber absorbs UV light to emit visible light. The field emission light source may be applied to a carbon nanotube field emission display etc., wherein an ultra high vacuum environment is provided, and an electron emitter of nano carbon material on the cathode is produced for helping electrons to overcome the work function of the cathode to escape from the cathode due to the high aspect-ratio microstructure of the electron emitter. In addition, a phosphor layer is disposed on the anode made of indium tin oxide (ITO), and electrons escape from carbon nanotube of the cathode under the effect of high electric field between the cathode and the anode. Thus, electrons may react with the phosphor layer on the anode in the vacuum environment to emit visible light.

However, there are disadvantages in both aforementioned light emitting devices. For example, considering the attenuation after UV irradiation, the material selection for gas discharge light source should meet a special requirement. Moreover, the light emitting mechanism of gas discharge requires two processes to emit a visible light, thus, the energy loss is considerable, and it will cost more if plasma needs to be generated during the process. In another aspect, electron emitter has to be evenly grown or disposed on the cathode of the field emission light source, however, the technology of mass-producing of such cathode structure is still immature, and the problems of poor electron emitter uniformity and poor production yield are still not resolved. Moreover, the space between the cathode and the anode of field emission light source requires precise control, and ultra high vacuum packaging is difficult to process, so the cost of production increases accordingly.

In addition, it is important for thinning the light emitting devices and improving the light emitting uniformity when designing a new light emitting device.

SUMMARY OF THE INVENTION

Accordingly, the present invention is directed to an electron emission device capable of uniformly emitting light and satisfying the tendency of thinning device.

The present invention is further directed to a method of packaging an electron emission device capable of filling a gas fast and conventionally.

In the present invention, an electron emission device including a first substrate, a second substrate, a gas, a sealant, and a phosphor layer is provided. The first substrate has a cathode thereon, and the cathode has a patterned profile. The second substrate is opposite to the first substrate and has an anode thereon. The sealant is disposed at edges of the first substrate and the second substrate to assemble the first and second substrates. The gas is disposed between the cathode and the anode and configured to induce a plurality of electrons from the cathode, wherein the pressure of the gas is between 10 torr and $10^{-3}$ torr. The phosphor layer is disposed on the moving path of the electrons to react with the electrons so as to emit light.

A method of packaging an electron emission device is also provided. An electron emission device comprising a first substrate and a second substrate is provided, wherein the first substrate has a cathode thereon, the second substrate has an anode thereon, and a phosphor layer is disposed on the cathode or anode. A sealant is formed between the first substrate and the second substrate, wherein the sealant has an opening. A tube is disposed at the opening of the sealant. The tube is connected with a pipe, and the pipe connects to a gas-exhausting apparatus and a gas-filling apparatus. Next, the electron emission device is heated and the gas in the electron emission device is exhausted by using the gas-exhausting apparatus. The, the gas-exhausting apparatus is turned off and the gas-filling apparatus is turned on to fill a gas into the electron emission device. Finally, the tube is blown so as to seal the opening of the sealant.

In light of the foregoing, because the cathode of the electron emission device has a patterned profile, the electric field edge effect between the anode and the cathode is dispersed, such that the light emitting uniformity is improved and the thickness of the electron emission device can be reduced.

In order to make the aforementioned and other features and advantages of the present invention more comprehensible, several embodiments accompanied with figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

The electron emission device of the present invention has advantages of both the conventional gas discharge light source and the conventional field emission light source, and overcomes disadvantages of both aforementioned light emitting devices. To be specific, there is no need to form electron emitter in the electron emission device of the present invention; instead, electrons are induced easily from the cathode by using thin gas and react directly with the phosphor layer to emit light. Comparing with conventional gas discharge light source, the amount of the gas filled in the electron emission device of the present invention is enough when meeting the requirement of inducing electrons from the cathode. Since the UV light is not adopted in the present invention to irradiate the phosphor layer for emitting light, attenuation of materials in the device due to the UV irradiation is eliminated. According to experiments and theory, the gas is thin in electron emission device of the present invention, so the mean free path of electrons could reach to about 5 mm or above. In other words, most of the electrons react directly with the phosphor layer to emit visible light before they collide with molecules of the gas. In addition, the electron emission device of the present invention doesn't require two processes for emitting light, so the light emitting efficiency is high, and the energy lost is low.

In another aspect, the electron emission device of the present invention could induce electrons from the cathode by using the gas, there's no need to form a microstructure of electron emitter on the cathode, so the producing cost is saved and the producing procedure is relatively simple. In addition, since thin gas is filled in the electron emission device of the present invention, ultra high vacuum environment is unnecessary, this may avoid the difficult situations when processing ultra high vacuum packaging. Moreover, from experiments we know, with the assistance of gas, the turn on voltage of electron emission device of the present invention could reduce to about 0.4V/μm, which is far more lower than the turn on voltage 1~3V/μm of an ordinary field emission light source. Moreover, according to known formula Child-Langmuir, when inputting the actual corresponding data of the electron emission device of the present invention, the result shows the distribution range of dark area of the cathode in the electron emission device of the present invention is between 10~25 cm, it's far more larger than the distance between the cathode and the anode. In other words, there almost no gas of plasma state is generated between the cathode and the anode. So it can be determined that the electron emission device of the present invention does not use plasma mechanism for emitting light, but using the gas to induce electrons from the cathode, and the electrons react directly with the phosphor to emit light.

Figure 1:
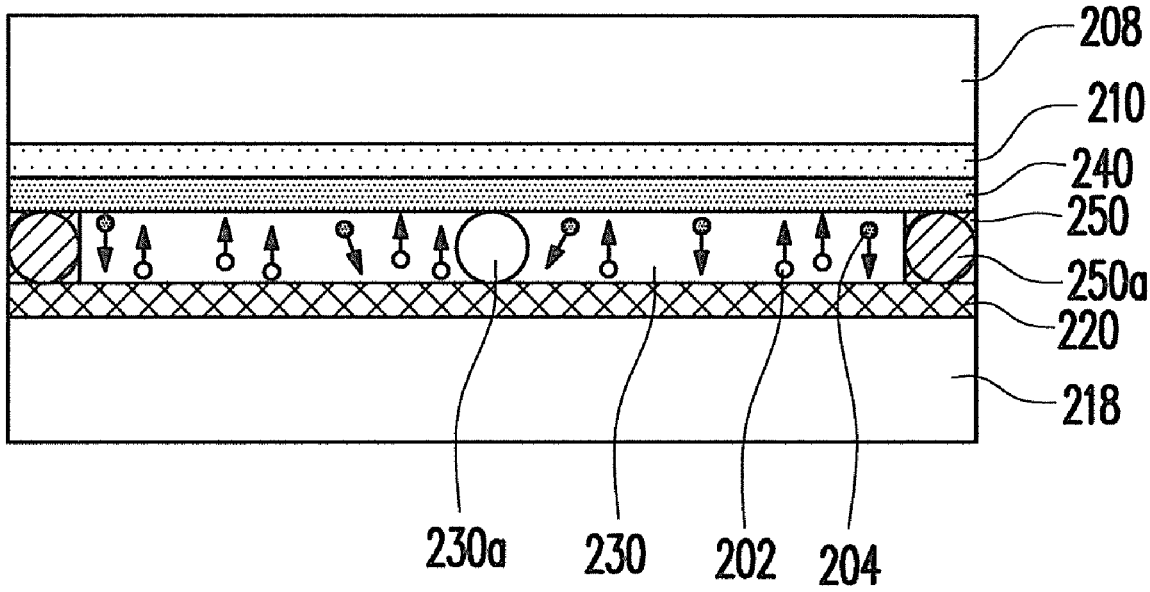
FIG. 1 is a cross section view of an electron emission device according to an embodiment of the present invention.

FIG. 1 is a cross section view of an electron emission device according to an embodiment of the present invention. As shown in FIG. 1, the electron emission device includes a first substrate 218, a second substrate 208, a gas 230, a sealant 250, and a phosphor layer 240. The first substrate 218 has a cathode 220 thereon, and the second substrate 208 has an anode 210 thereon.

The anode 210 may be made of a transparent conductive oxide (TCO) for the light to pass through and go outside of the electron emission device, wherein the transparent conductive oxide may be the common used material like indium tin oxide (ITO) or indium zinc oxide (IZO) etc. Certainly, in other embodiments, the anode 210 may be made of metal or other materials with good conductivity. The cathode 220 may be made of a transparent conductive oxide or metal, wherein the transparent conductive oxide may be the common used material like indium tin oxide or indium zinc oxide etc. It should be noted that at least one of the anode 210 and the cathode 220 is made of a transparent conductive oxide so as to enable the light go outside of the electron emission device through the anode 210, the cathode 220 or both of them.

Generally, the electric field having higher density is generated between the edges of two plate electrodes, and it is also called electric field edge effect. If the distance between the two electrodes is more and more short, the electric field edge effect is more serious, and thus the light emitting uniformity is deteriorated. The electric field edge effect should be considered when designing a thinning electron emission device. Therefore, in the following embodiments, the cathode of the electron emission device is specifically designed so as to disperse the electric field edge effect. That is to say, the cathode is designed to have a patterned profile. Because the edge of each of the patterns on the cathode causes the electric field edge effect, the electric field edge effect on the cathode is dispersed. Hence, the electric field edge effect does not focus on the four edges of the electron emission device. The cathode may be formed with the method shown in FIG. 2A or FIG. 2B.

Figure 2A:
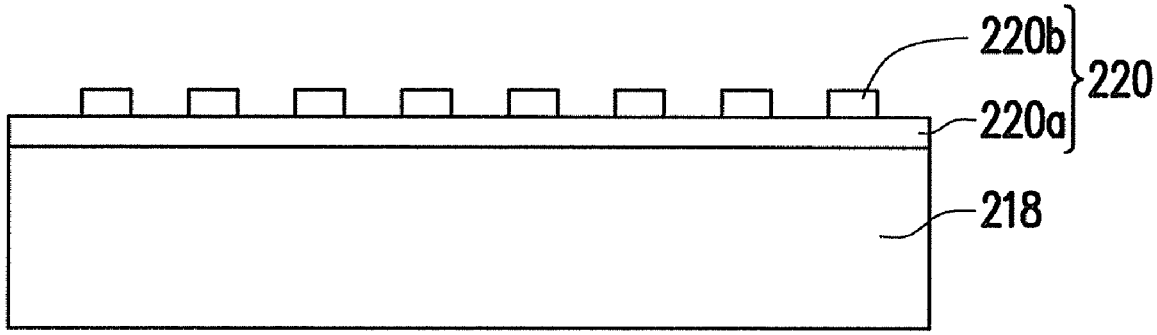
FIG. 2A and FIG. 2B are cross section views of cathodes of the electron emission device according to embodiments of the present invention.

As shown in FIG. 2A, according to the embodiment, the cathode 220 is formed by forming a conductive layer 220*a* on the first substrate 218, and then forming a plurality of conductive patterns 220*b* on the conductive layer 220*a*, such that the cathode 220 has a patterned profile. That is, the surface of the cathode 220 is not smooth because of the conductive patterns 220*b*. The conductive patterns 220*b* are formed, for example, by performing a depositing process and an etching process, or by performing a depositing process with a shadow mask. The conductive patterns 220*b* may be stripe type, block type or island type, and may have any shape. The materials of the conductive layer 220*a* and the conductive patterns 220*b* may be transparent conductive oxide or metal, and the materials of the conductive layer 220*a* and the conductive patterns 220*b* may be the same or different.

Figure 2B:
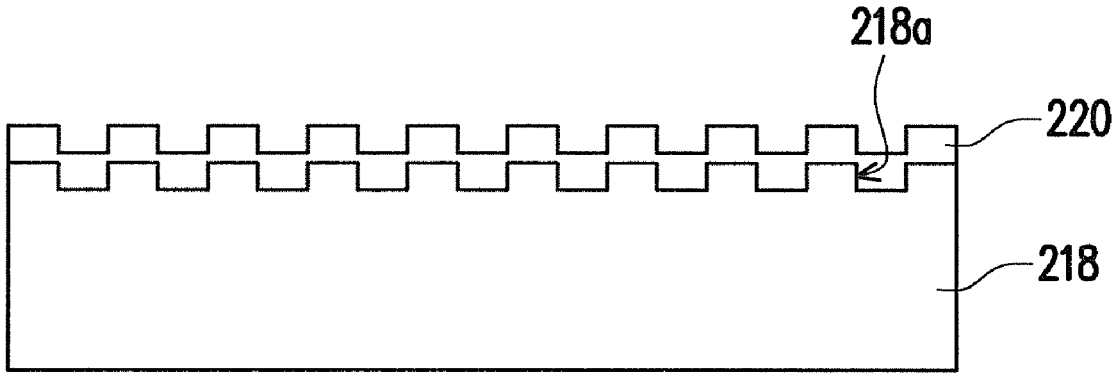
Figure 3:
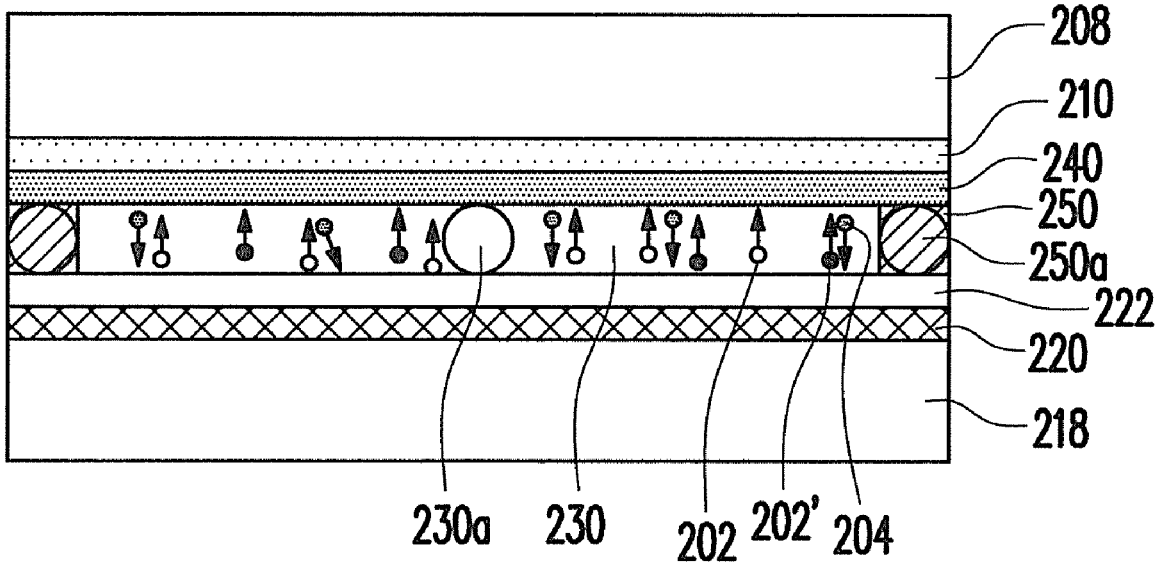
FIGS. 3-6 are cross section views of electron emission devices according to embodiments of the present invention.

According to another embodiment, the cathode 220 is formed, as shown in FIG. 2B, by forming a plurality of grooves 218*a* on the first substrate 218, and then forming a conformal conductive layer 220 covering the grooves 218*a* on the first substrate 218 so as to form the cathode 220 having a patterned profile. The grooves 218*a* on the first substrate 218 may be formed with a supersonic process, for example. Similarly, the grooves 218*a* on the first substrate 218 may be trench type or hole type, and may have any shape.

Referring to FIG. 1, in addition to the cathode 220 and the anode 210, the electron emission device further comprises the phosphor layer 240, the sealant 250, and the gas 230.

The phosphor layer 240 is disposed on the moving path of the electrons 202 to react with the electrons 202 and emit light. In this embodiment, the phosphor layer 240 may be disposed on the surface of the anode 210. Moreover, the phosphor layer 240 emits various kinds of light as visible light, infrared light or UV light etc. by choosing various types of the phosphor layer 240.

The sealant 250 is disposed at the edges of the first substrate 218 and the second substrate 208 so as to assemble the first and second substrates 218, 208. The sealant 250 may be a UV curable sealant, a thermal curable sealant or other suitable sealants. According to an embodiment, a plurality of spacers 250*a* are further distributed in the sealant 250 to enhance the strength of the sealant 250. Furthermore, a plurality of spacers 230*a* may be distributed inside the electron emission device, based on the size of the electron emission device, so as to support the gap between the first substrate 218 and the second substrate 208.

As above mentioned, the cathode 220 has a patterned profile, and thus the electric field edge effect between the two electrodes is dispersed. Not only the light emitting uniformity can be improved, but also the objective of thinning the electron emission device can also be achieved. In details, if the distance between the cathode and the anode is reduced to thin the electron emission device, the emitting uniformity is not deteriorated due to the electric field edge effect between the two electrodes is dispersed. Therefore, the traditional glass frames are not needed in the electron emission device in the embodiment. That is, the first substrate 218 and the second substrate 208 can be assembled with the sealant 250 directly, such that the thickness of the electron emission device is substantially reduced.

The gas 230 is filled between the anode 210 (the phosphor layer 240), the cathode 220 and the sealant 250. The gas 230 generates adequate positive ions under the effect of the electric field to induce electrons 202 from the cathode 220. In this embodiment, the pressure of the gas 230 is between 10 torr and $10^{-3}$ torr, preferably, between $2\times10^{-2}$ torr and $10^{-3}$ torr, which is related to the distance between the cathode 220 and the anode 210. Additionally, the gas 230 applied in the present invention may be selected from the inert gases (such as He, Ne, Ar, Kr or Xe), $H_2$, $CO_2$, O2, air or the gases with good conductivity when dissociated.

Beside the embodiment shown in FIG. 1, for improving light emitting efficiency, materials that are easy to generate electrons may be further disposed on the cathode to provide additional electron source. FIG. 2 illustrates an electron emission device according to another embodiment of the present invention, which is similar to the device of FIG. 1 and the difference therebetween is that the device of FIG. 2 further includes a secondary electron source material layer 222 on the cathode 220. The material of the secondary electron source material layer 222 may be MgO, $Tb_2O_3$, $La_2O_3$ $Al_2O_3$ or $CeO_2$. Since the gas 230 may generates free ions 204, and the positive ions 204 leave the anode 210 and move towards the cathode 220. Thus, when the ions 204 collide with the secondary electron source material layer 222 on the cathode 220, additional secondary electrons 202' are generated. More electrons (includes original electrons 3202 and secondary electrons 202') react with phosphor layer 240 helps to increase light emitting efficiency. It is noticeable that the secondary electron source material layer 222 not only helps to generate the secondary electrons but also protects the cathode 220 from excessive bombardment of the ions 204.

Figure 4:
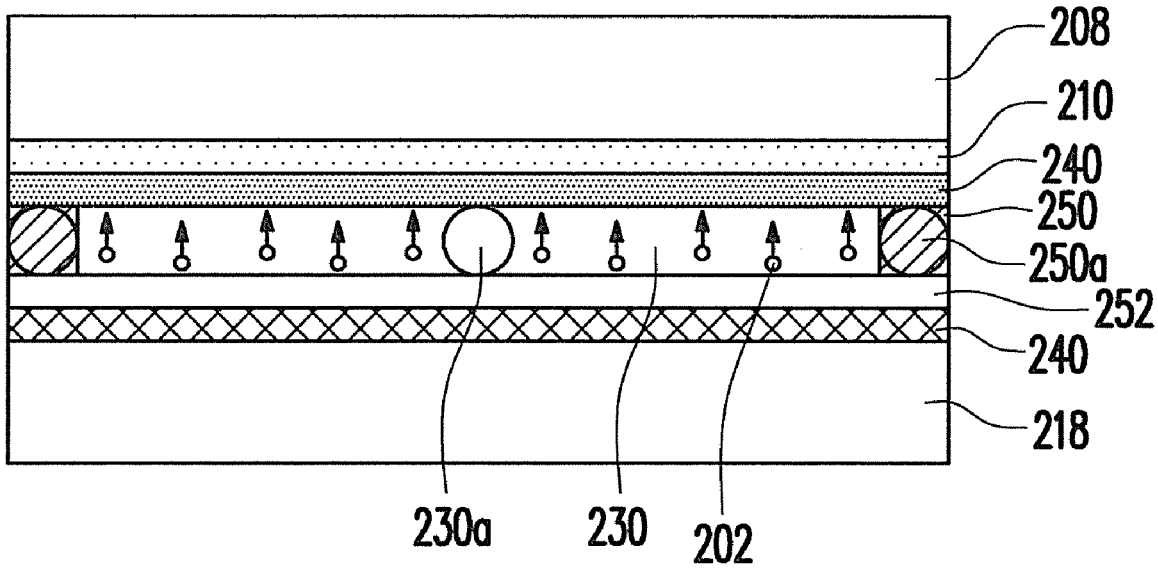
Figure 5:
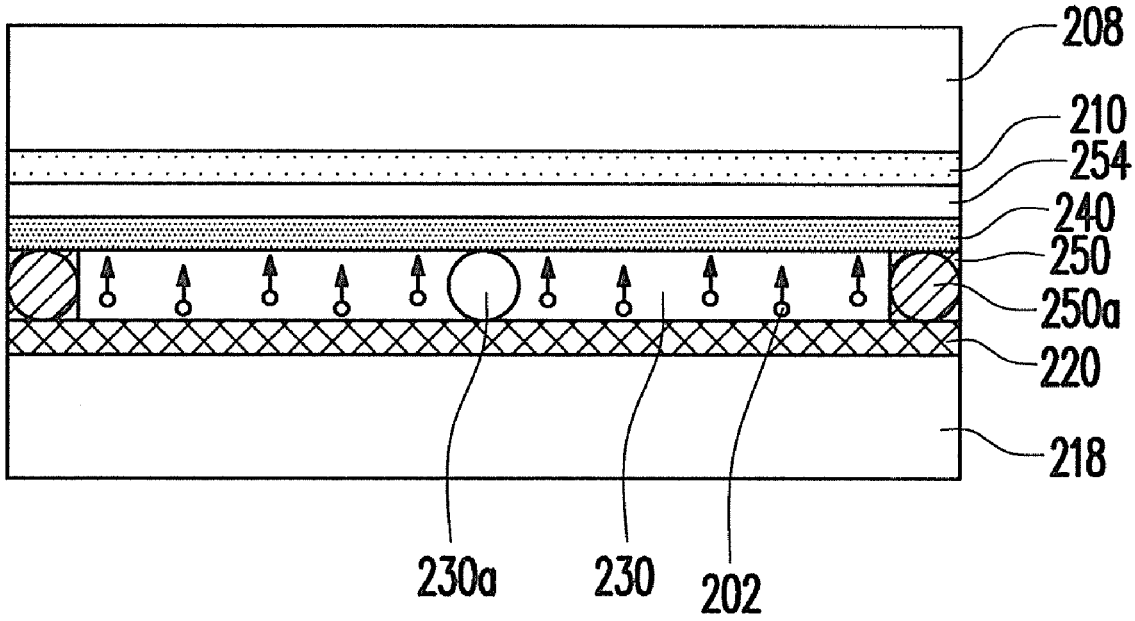
Figure 6:
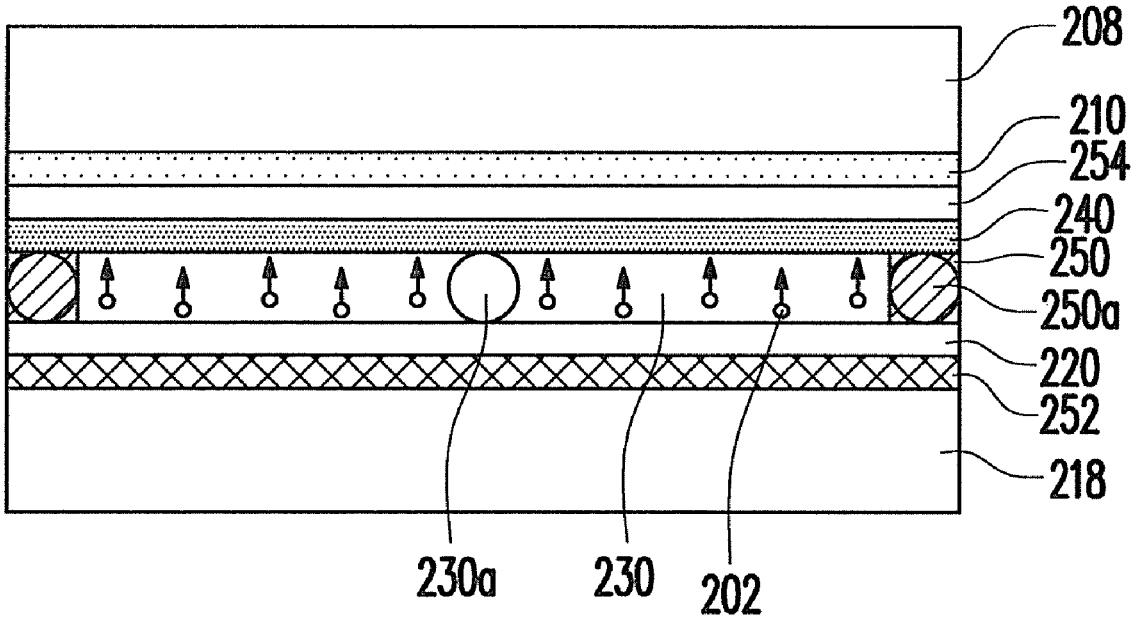

Moreover, the present invention may also choose on one of the anode and the cathode, or on both of them to form a structure similar to the electron emitter on the ordinary field emission light source. By this way, the working voltage on electrodes is reduced, and electrons are much easier to be generated. FIGS. 4-6 respectively illustrates various electron emission devices having inducing discharge structure, wherein the same reference number indicate the similar parts, and the repeated description thereof will be omitted.

Referring to FIG. 4, the electron emission device further comprises an inducing discharge structure 252 on the cathode 220, it is a microstructure that may be made of metal, carbon nanotubes, carbo nanowalls, carbon nanoporous, columnar ZnO, or ZnO etc. In addition, the gas 230 is disposed between the anode 210 and the cathode 220, and the phosphor layer 240 is disposed on surface of the anode 210. The working voltage between the anode 210 and the cathode 220 may be reduced due to the inducing discharge structure 252, and the electrons 202 are much easier to be generated. The electrons 202 react with the phosphor layer 240 to emit light.

The electron emission device illustrated in FIG. 5 is similar to that in FIG. 4, the obvious difference is that an inducing discharge structure 254 is disposed on the anode 210 instead, and this inducing discharge structure 254 is a microstructure that may be made of aforementioned materials as metal, carbo nanotubes, carbon nanowalls, carbon nanoporous, columnar ZnO, or ZnO etc. In addition, the phosphor layer 240 is disposed on the inducing discharge structure 254.

FIG. 6 illustrates an electron emission device having both inducing discharge structures 254 and 252, wherein the inducing discharge structure 254 is disposed on the anode 210, the phosphor layer 240 is disposed on the inducing discharge structure 254, and the inducing discharge structure 252 is disposed on the cathode 220. The gas 230 is disposed between the anode 210 and the cathode 220.

The aforementioned electron emission devices having inducing discharge structure 252 and/or 254 may be further integrated as the design of the secondary electron source material layer 222 shown in FIG. 2 to form a secondary electron source material layer on the cathode 220. If an inducing discharge structure 254 is already formed on the cathode 220, the secondary electron source material layer may cover the inducing discharge structure 254. Thus, not only the working voltage between the anode 210 and the cathode 220 is reduced to benefit the generation of the electrons 202, but also the light emitting efficiency is improved due to the increment of the amount of the electrons 202 by applying the secondary electron source material layer.

Figure 7:
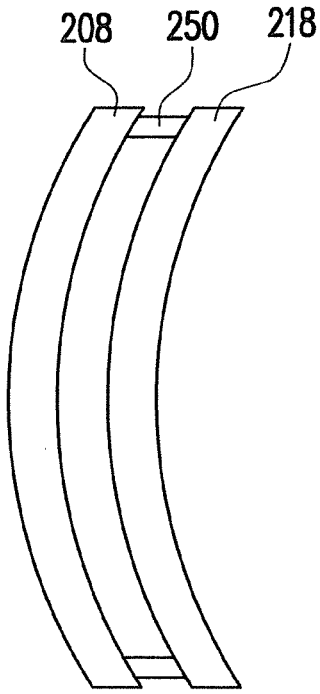
FIGS. 7-8 are cross section views of curved electron emission devices according to embodiments of the present invention.
Figure 8:
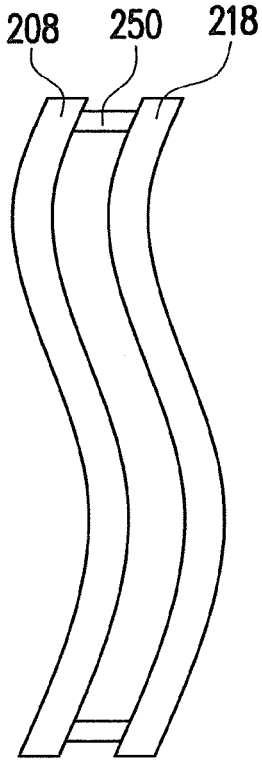

The electron emission devices in the above-mentioned embodiments are flat electron emission devices, but the present invention does not limit herein. According to another embodiment, the electron emission devices may be curved electron emission devices, as shown in FIGS. 7 and 8. In FIGS. 7 and 8, the first substrate 218, the second substrate 208 and the sealant 250 are shown and other film layers on the two substrates 218, 208 are omitted for illustration. As a matter of fact, the cathode, the anode and the phosphor layer have been formed on the first substrate 218 and the second substrate 208 as described in the above-mentioned embodiments, and in other embodiments the inducing discharge structure and/or the secondary electron source material layer may also be formed in the electron emission devices. Referring to FIGS. 7 and 8, the first substrate 218 and the second substrate 208 are not flat substrates but are curved substrates. The film layers formed on the first and second substrates 218, 208 are also curved in conformation. Hence, a curved electron emission device is obtained after assembling the two substrates.

Figure 9A:
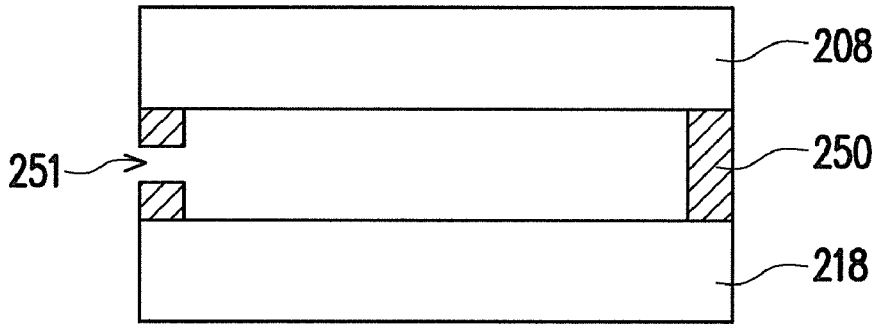
FIGS. 9A-9C are diagrams showing a method of packaging an electron emission device according to an embodiment of the present invention.
Figure 9B:
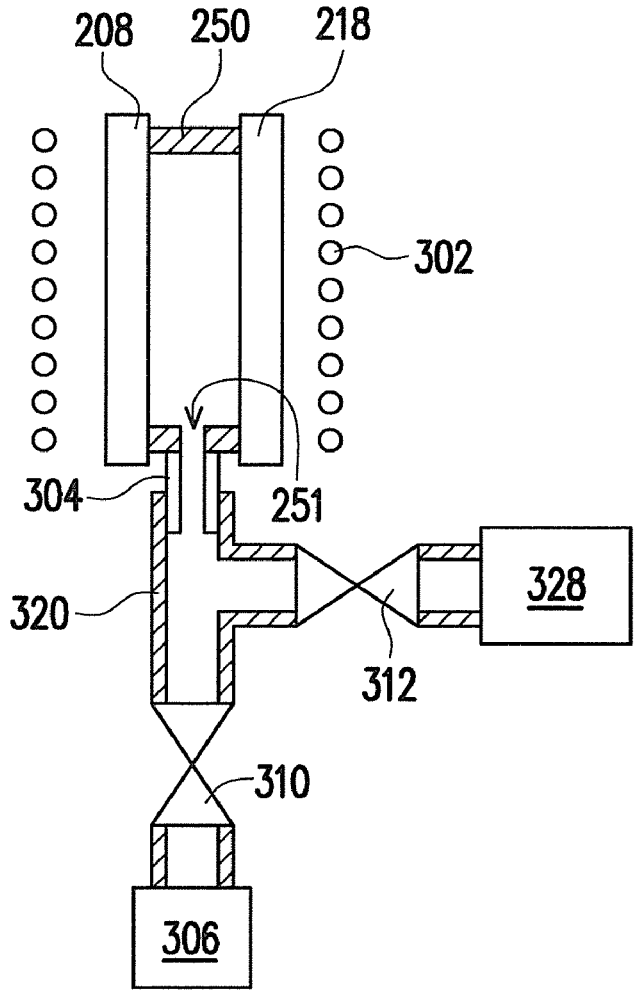
Figure 9C:
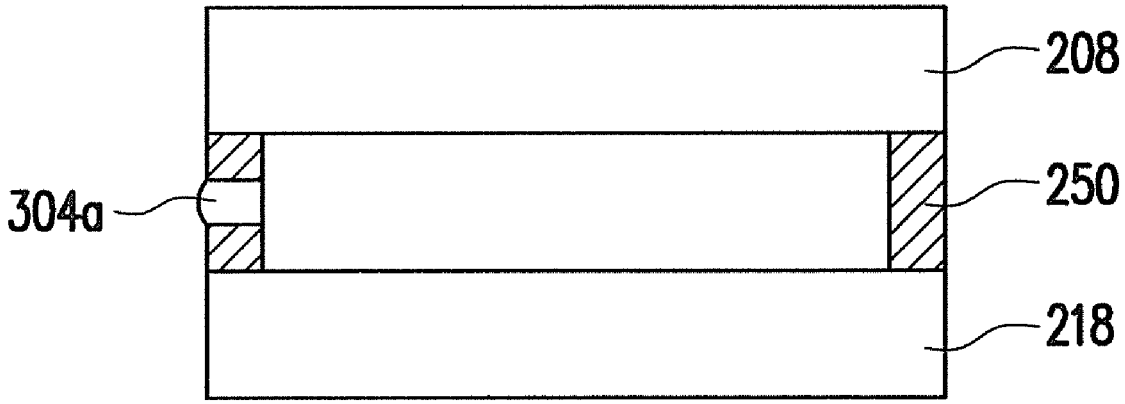

FIGS. 9A-9C are diagrams showing a method of packaging an electron emission device according to an embodiment of the present invention. As shown in FIG. 9A, an electron emission device comprising a first substrate 218 and a second substrate 208 is provided. In FIGS. 9A-9B, the first substrate 218 and the second substrate 208 are shown and other film layers on the two substrates 218, 208 are omitted for illustration. As a matter of fact, the cathode, the anode and the phosphor layer have been formed on the first substrate 218 and the second substrate 208 as described in the above-mentioned embodiments, and in other embodiments the inducing discharge structure and/or the secondary electron source material layer may also be formed in the electron emission devices.

Thereafter, a sealant 250 is formed between the first substrate 218 and the second substrate 208, and the sealant 250 has an opening 251. The sealant 250 may have spacers therein, and additional spacers may also be distributed between the two substrates 218, 208.

As shown in FIG. 9B, a tube 304 is disposed at the opening 251 of the sealant 250. The tube 304 may be a glass tube, for example. Next, the tube 304 is connected with a pipe 320, wherein the pipe 320 connects to a gas-exhausting apparatus 306 and a gas-filling apparatus 308. A valve 310 is further set on the pipe 320 between the tube 304 and the gas-exhausting apparatus 306, and a valve 312 is further set on the pipe 320 between the tube 304 and the gas-exhausting apparatus 308.

After that, a heating device 302 is disposed around the electron emission device to heat the electron emission device. The heating device 302 may be a coil-resistant heating device, for example, and the electron emission device is heated to 200~400° C., for example. Then, the valve 310 and the gas-exhausting apparatus 306 are turned on so as to exhaust the gas in the electron emission device. Next, the valve 310 and the gas-exhausting apparatus 306 are turned off and the valve 312 and the gas-filling apparatus 308 are turned on to fill a gas into the electron emission device. The gas filled into the electron emission device may be selected from the inert gases (such as He, Ne, Ar, Kr or Xe), $H_2$, $CO_2$, O2, air or the gases with good conductivity when dissociated.

Finally, the tube 304 is blown so as to seal the opening 251 of the sealant 250, as shown in FIG. 9C. The blown tube 304 serves as a sealing stopper so as to prevent the gas inside the electron emission device from flowing out of the electron emission device. Here, the electron emission device is completely packaged.

In light of the foregoing, because the cathode of the electron emission device has a patterned profile, the electric field edge effect between the anode and the cathode is dispersed, such that the emitting uniformity is improved. In addition, the distance between the cathode and the anode can be reduced to thin the electron emission device, and the emitting uniformity is not deteriorated due to the electric field edge effect between the two electrodes is dispersed.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electron emission device, comprising:

a first substrate, having a plurality of grooves thereon, and a conductive layer conformally covers the grooves on the first substrate so as to form a cathode having a patterned profile;

a second substrate, opposite to the first substrate and having an anode thereon;

a sealant, disposed at edges of the first substrate and the second substrate to assemble the first and second substrates;

a gas, disposed between the cathode and the anode, configured to induce a plurality of electrons from the cathode, wherein the pressure of the gas is between 10 torr and $10^{-3}$ torr; and a phosphor layer, disposed on the moving path of the electrons to react with the electrons so as to emit light.

2. The electron emission device as claimed in claim 1, further comprising a secondary electron source material layer, disposed on the cathode.

3. The electron emission device as claimed in claim 1, wherein the gas comprises inert gas, $H_2$, $CO_2$, $O_2$ or air.

4. The electron emission device as claimed in claim 1, further comprising a plurality of first spacers distributed in the sealant.

5. The electron emission device as claimed in claim 1, further comprising a plurality of second spacers distributed between the cathode and the anode.

6. The electron emission device as claimed in claim 1, wherein the first substrate and the second substrate are flat substrates or curved substrates.

7. The electron emission device as claimed in claim 1, wherein the phosphor layer is disposed on the surface of the anode.

8. The electron emission device as claimed in claim 1, wherein the anode comprises a transparent conductive oxide.

9. The electron emission device as claimed in claim 1, wherein the material of the anode and the cathode comprises a metal.

10. The electron emission device as claimed in claim 1, further comprising an inducing discharge structure, disposed on at least one of the anode and the cathode.

11. The electron emission device as claimed in claim 10, wherein the inducing discharge structure comprises a metal, carbon nanotubes, carbon nanowalls, carbon nanoporous, columnar ZnO, or ZnO.

12. The electron emission device as claimed in claim 11, wherein material of the secondary electron source material layer comprises MgO, $SiO_2$, $Tb_2O_3$, $La_2O_3$, $Al_2O_3$, or $CeO_2$.

13. An electron emission device, comprising:

a first substrate, having a cathode thereon, wherein the cathode comprises a non-patterned conductive layer and a plurality of conductive patterns on a surface of the non-patterned conductive layer;

a second substrate, opposite to the first substrate and having an anode thereon;

a sealant, disposed at edges of the first substrate and the second substrate to assemble the first and second substrates;

a gas, disposed between the cathode and the anode, configured to induce a plurality of electrons from the cathode, wherein the pressure of the gas is between 10 torr and $10^{-3}$ torr; and a phosphor layer, disposed on the moving path of the electrons to react with the electrons so as to emit light.

* * * * *